US009038518B2

(12) United States Patent
Gao et al.

(10) Patent No.: US 9,038,518 B2
(45) Date of Patent: May 26, 2015

(54) AUTOMATIC PAPER CUTTING DEVICE

(76) Inventors: Jianxin Gao, Jinan (CN); Xuyang Liu, Jinan (CN)

( * ) Notice: Subject to any disclaimer, the term of this patent is extended or adjusted under 35 U.S.C. 154(b) by 335 days.

(21) Appl. No.: 13/591,137

(22) Filed: Aug. 21, 2012

(65) Prior Publication Data

US 2014/0013910 A1 Jan. 16, 2014

(30) Foreign Application Priority Data

Jul. 11, 2012 (CN) ..... 2012 2 0336648

(51) Int. Cl.
*A47K 10/38* (2006.01)
*B26D 1/56* (2006.01)
*A47K 10/36* (2006.01)

(52) U.S. Cl.
CPC ..... *A47K 10/3612* (2013.01); *B26D 1/56* (2013.01)

(58) Field of Classification Search
USPC ..... 83/648, 649
See application file for complete search history.

(56) References Cited

U.S. PATENT DOCUMENTS

2002/0096028 A1* 7/2002 Morand ..... 83/13
2002/0117034 A1* 8/2002 Granger ..... 83/338
2005/0051008 A1* 3/2005 Granger ..... 83/335
2006/0236832 A1* 10/2006 Cvjetkovic et al. ..... 83/337
2006/0266784 A1* 11/2006 Kananen ..... 225/6
2007/0079676 A1* 4/2007 Friesen et al. ..... 83/37
2007/0234868 A1* 10/2007 Formon et al. ..... 83/649

* cited by examiner

*Primary Examiner* — Stephen Choi

(57) ABSTRACT

An automatic paper cutting device, includes: a paper reel frame for supporting the paper; and a core unit, wherein the core unit comprises a paper rolling shaft which a head portion of the paper reel rolls around, and the paper rolling shaft is connected to a cutting device. The present invention simplifies the internal structure for realizing the functional requirement that the structure are simpler and the accessories are fewer, the structure of the automatic paper cutting device is simpler, the automatic paper cutting device works more stable, the paper is outputted more smoothly, and the paper of different thickness and quality is capable of being cut automatically.

3 Claims, 4 Drawing Sheets

AUTOMATIC PAPER CUTTING DEVICE

BACKGROUND OF THE PRESENT INVENTION

1. Field of Invention

The present invention relates to a field of daily necessity, and more particularly to a paper cutting device.

2. Description of Related Arts

Paper is ordinarily installed on the paper reel frame at the traditional pubs, hotels, or airports. It is inconvenient and unsanitary that the paper is rolled and torn for a certain length manually when using. There are a number of automatic paper cutting devices with different styles and different internal structures on the market nowadays, which are convenient and sanitary, but the internal structures are complicated and the accessories are numerous. Although the functional requirement of the automatic paper cutting devices is simple, which is only two actions of outputting the paper of the same length and cutting the paper, it is likely to result the shortcoming of complicated structure to realize this function requirement.

SUMMARY OF THE PRESENT INVENTION

An object of the present invention is to provide a paper cutting device to solve the above technical problem.

Accordingly, in order to accomplish the above object, the present invention provides an automatic paper cutting device, comprising a paper reel frame for supporting the paper reel and a core unit, wherein the core unit comprises a paper rolling shaft which a head portion of the paper reel rolls around, and the paper rolling shaft is connected to a cutting device.

The head portion of the paper reel rolls around the paper rolling shaft, when a user pulls out the head portion, the paper rolling shaft rolls and the paper reel is driven to roll, when the paper of a certain length is outputted, the paper cutting device is driven to implement cutting.

The core unit comprises a left core unit frame and a right core unit frame; a connecting shaft is provided at the center of the paper rolling shaft, the paper rolling shaft is installed on the left core unit frame and the right core unit frame via the connecting shaft.

A paper inputting guiding roller is provided between the paper rolling shaft and the paper reel frame, the head portion of the paper reel rolls on the paper rolling shaft. A first left fixed sleeve and a first right fixed sleeve are provided at the two ends of the paper inputting guiding roller. The paper inputting guiding roller is provided on the left core unit frame and the right core unit frame via the first left fixed sleeve and the first right fixed sleeve.

A first extension spring is connected with the first left fixed sleeve, a second extension spring is connected with the first right fixed sleeve, the first left fixed sleeve and the first right fixed sleeve are respectively provided on the left core unit frame and the right core unit frame via the first extension spring and the second extension spring.

The core unit further comprises a paper outputting guiding roller, wherein a second left fixed sleeve and a second right fixed sleeve are provided at the two ends of the paper outputting guiding roller. The paper outputting guiding roller is provided on the left core unit frame and the right core unit frame via the second left fixed sleeve and the second right fixed sleeve. The head portion of the paper reel rolls on the paper outputting guiding roller through the paper rolling shaft. The paper outputting guiding roller is provided at a first side of the paper rolling shaft, the paper inputting guiding roller is provided at a second side of the paper rolling shaft.

The paper rolling shaft comprises two detachable connecting parts, the two parts of the paper rolling shaft are connected with each other by connectors, the connectors comprise crews. The two parts of the paper rolling shaft are connected with each other via the crews or other fastening mechanisms.

The paper rolling shaft has a long strip groove which the cutting device is provided in. The cutting devices comprise a paper cutter frame, a paper cutter movably connected with the paper cutter frame. The paper cutter frame comprises a left paper cutter frame and a right paper cutter frame, the left paper cutter frame and the right paper cutter frame are respectively connected with guiding pins, the left paper cutter frame and the right paper cutter frame are fixedly connected with the paper rolling shaft via the guiding pins. The paper cutter frame is connected with a crank mechanism, the paper cutter frame is connected with the connecting shaft to implement rolling synchronously via the crank mechanism. Preferably, the right paper cutter frame is connected with the crank mechanism. When the connecting shaft rolls, the paper cutter frame keeps rolling synchronously via the crank mechanism, when the crank mechanism rolls for a stroke, the paper cutter implements cutting paper. When designing, the dimension parameters of the crank mechanism are determined according to the length of the paper outputted each time for insuring that the paper cutter is capable of protruding automatically at a proper position when the connecting shaft rolls, so as to implement outputting the paper of the same length.

The cutter is movably connected with the paper cutter frame, at least 12 cutter teeth are provided on the paper cutter. The cutter teeth bend for a pre-set angle. At a first runtime state, the cutter teeth of the paper cutter do not protrude and do not cut down the paper, at a second runtime state, the crank mechanism rolls for a stroke, the cutter teeth bend to one direction in such a manner that when the cutter stretches out, the cutter teeth upturn to implement cutting paper. When the paper rolling shaft rolls for driving the cutter to stretch out at a proper position, it will be simpler and more laborsaving to cut the paper because of the upturning angle; and since the paper cutter rotation direction is the same as the paper outputting direction, it is easier to output the paper by this upturning angle.

The paper rolling shaft comprises adhesive tapes, at least four adhesive tapes separated from each other are provided along the axial direction of the paper rolling shaft. It is easy to grasp the paper rolling on the paper rolling shaft by using the paper rolling shaft with the adhesive tapes. The paper rolling shaft has a sticking position for installing the adhesive tapes, the shape of the adhesive tapes is a circular ring. The circular ring adhesive tapes are directly stuck in the sticking position.

The adhesive tapes are made from the separate circular accessories made of the overmolded plastic package. The adhesive tapes directly buckle into the sticking position. Base on ensuring the smooth outputting of paper, the structure that the paper rolling shaft has to be made of the overmolded plastic package overall is simplified, and the cost is reduced.

The connecting shaft is connected with an unidirectional spring device, the unidirectional spring device comprises an unidirectional spring, a first end of the unidirectional spring is fixedly connected with the connecting shaft, a second end of the unidirectional spring is connected with a connecting rod mechanism, the connecting rod mechanism comprises a connecting rod and a connecting rod hinge, the connecting rod hinge is connected with the connecting rod. The connecting rod mechanism is connected with an extension spring, a first end of the extension spring is connected with the connecting rod hinge, a second end of the extension spring is connected with an extension spring guiding wheel, the extension spring is fixedly connected with the left core unit frame via the extension spring guiding wheel.

The unidirectional spring sleeves on the connecting shaft.

A user can pull out the paper by hand according to the present invention, under the combined effect of the extension spring, the unidirectional spring device and the connecting rod mechanism, the paper will not reverse into the inner of the mechanism totally, but the paper will be reserved for a short length for pulling out the paper by a next user.

A core unit backplane is provided on the back of the core unit, the core unit backplane comprises a core unit front backplane and a core unit back backplane. The connecting surface between the core unit front backplane and the core unit back backplane comprises a connector, the core unit front backplane is connected with the core unit back backplane via the connector.

Preferably, the core unit front backplane is connected with the core unit back backplane by the buckle.

Plug-in assemblies are provided on the core unit front backplane and the side surface of the core unit back backplane, holes matching with the plug-in assemblies are provided on the left core unit frame and the right core unit frame. The core unit front backplane and the core unit back backplane are installed on the left core unit frame and the right core unit frame by the plug-in assemblies.

The core unit further comprises a paper outputting guiding plate, long strip holes are provided on the two sides of the paper outputting guiding plate, keys matching with the long strip holes are provided on the left core unit frame and the right core unit frame, the paper outputting guiding plate is provided on the left core unit frame and the right core unit frame through the coupling of the long strip holes and the keys. At least two guiding paper convexes are provided on the bottom of the paper outputting guiding plate, the guiding paper convexes fit the paper outputting guiding roller for pressing the outputted paper to output the cut paper smoothly.

Alternatively, a barb connector is provided on the paper outputting guiding plate, the paper outputting guiding plate is connected with the left core unit frame and the right core unit frame via the barb connector.

A rotated button is provided on the outer of the right core unit frame, which is installed on the connecting shaft for adjusting easily in installing process.

The paper reel frame comprises a left frame and a right frame. The left frame is opposite to the right frame, frame convexes is provided on the surface of the left frame which is opposite to the right frame, the frame convexes is for supporting the paper reel when the left frame is opposite to the right frame. The diameter of the paper reel is 1.5 inches. The bottoms of the left frame and the right frame are connected with the base by plugging.

The diameter of the paper shaft of the paper reel also can be 2 inches or 2.25 inches. Adapters are respectively connected with the frame convexes provided on the left frame and the right frame when the diameter of the paper shaft of the paper reel is 2 inches or 2.25 inches. The adapters comprise the adapters adapting to the paper reels that the diameters of the paper shafts are 2 inches and 2.25 inches. Different adapters are inserted for adapting to the paper reels that the diameters of the paper shafts are different.

A base is fixedly connected with the core unit and the paper reel frame, a shell is provided on the core unit and the outer of the paper reel frame, the shell comprises a front shell portion and a transparent window which is coupled with the front shell.

A clamper is provided on the contacting surface between the front shell and the transparent window, the front shell is fixedly connected with the transparent window by the clamper to implement the inserting fixedly connection, the front shell is connected with the base by hinging from under to open and close up and down. A lock is provided on the base which directly stretches out from the base, a keyhole matching with the lock is provided on the shell, the lock is inserted into the keyhole directly when closing the shell, a professional key is inserted into the keyhole and pressed down when opening the shell. Two dedicated keys are molded directly by injecting on the base, a first key is for daily, a second key is for backup.

An ozone generator is provided at the inner of the frame convex, the gas outlet of the ozone generator is provided at the inner of the shell through the frame convexes; a power inputting terminal is provided on the ozone generator.

The two ends of the connecting shaft or the paper inputting guiding roller stretch out from the left core unit frame or the right core unit frame, and a variable speed mechanism is connected with an electric generator, the variable speed mechanism is an accelerated mechanism; the power outputting terminal of the electric generator is connected with the power inputting terminal.

The electric generator is driven to roll when the paper reel is drawn to roll for generating electricity, the ozone generator is drove by the generated electricity for generating ozone to disinfect the paper reel. The remaining ozone which has disinfected the paper reel releases into the external space for sterilizing, disinfecting and deodorizating the air in the toilet.

Further preferably, the power outputting terminal of the electric generator is connected with the power inputting terminal of the electric generator by a battery, a power management module is provided between the battery and the power inputting terminal, the power management module is outputted electricity when the battery voltage is bigger than a pre-set value till the battery voltage is smaller than another pre-set value. The function of storing enough electric energy in the battery to keep the ozone generator working for a period of time and supplying electric energy after the ozone generator works for a period of time is realized. The problem that the ozone generator works in the unstable intermittent state for a long time or even can not work is avoided.

The beneficial effect is that: the present invention simplifies the internal structure for meeting the functional requirement that the structure are simpler and the accessories are fewer, the structure of the automatic paper cutting device is simpler, the automatic paper cutting device works more stable, the paper is outputted more smoothly, and the paper of different thickness and quality is capable of being cut automatically.

These and other objectives, features, and advantages of the present invention will become apparent from the following detailed description, the accompanying drawings, and the appended claims.

DETAILED DESCRIPTION OF THE PREFERRED EMBODIMENT

Figure 1:
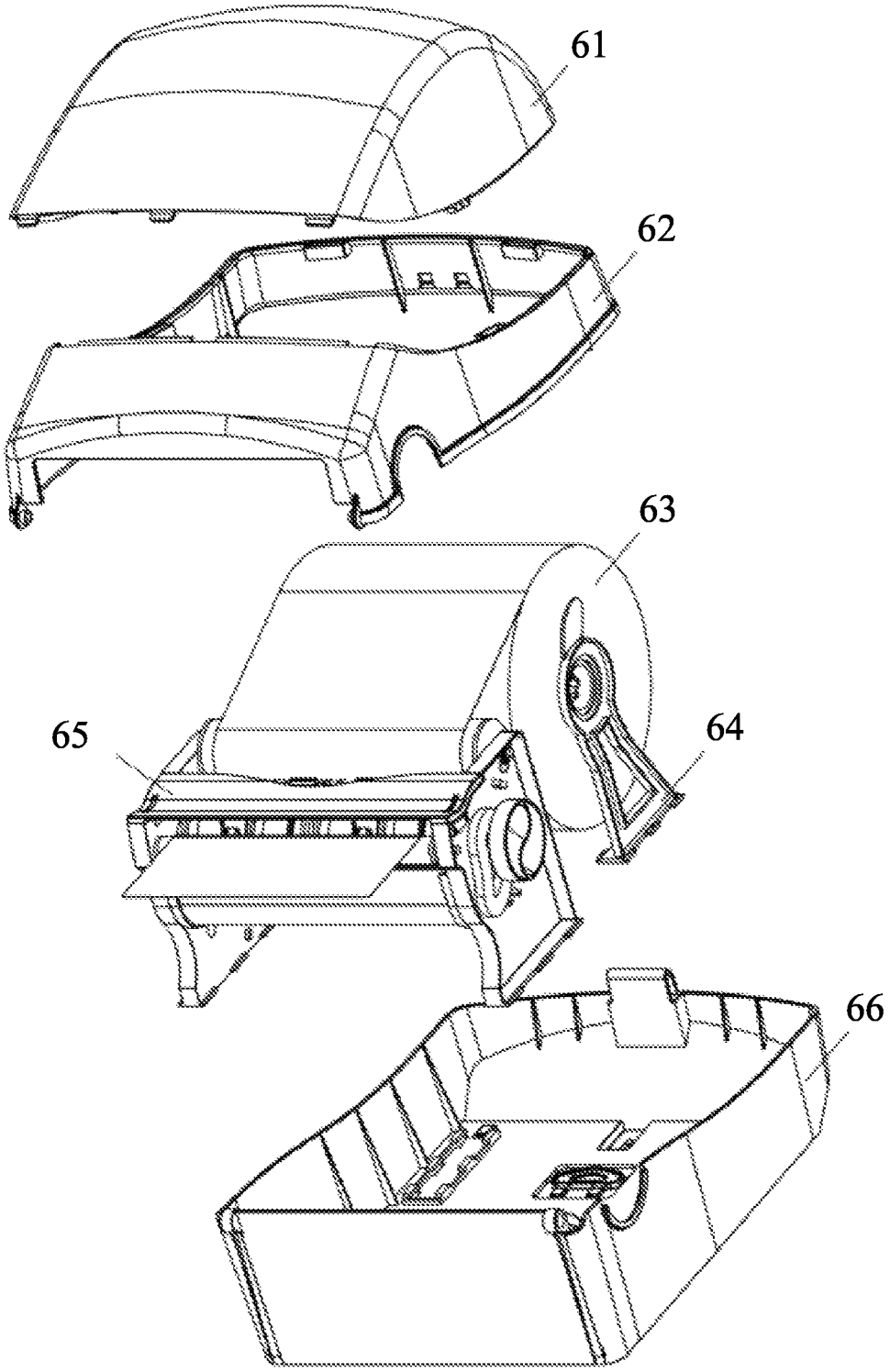
FIG. 1 is an exploded view of an automatic paper cutting device according to the present invention.
Figure 2:
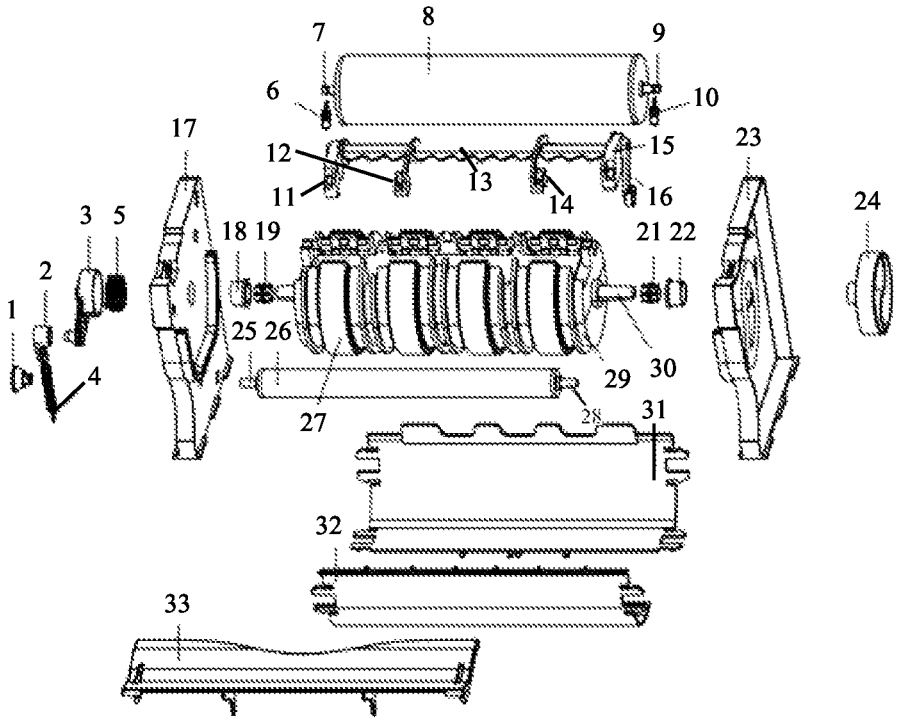
FIG. 2 is an exploded view of the core unit of the automatic paper cutting device according to the present invention.
Figure 3:
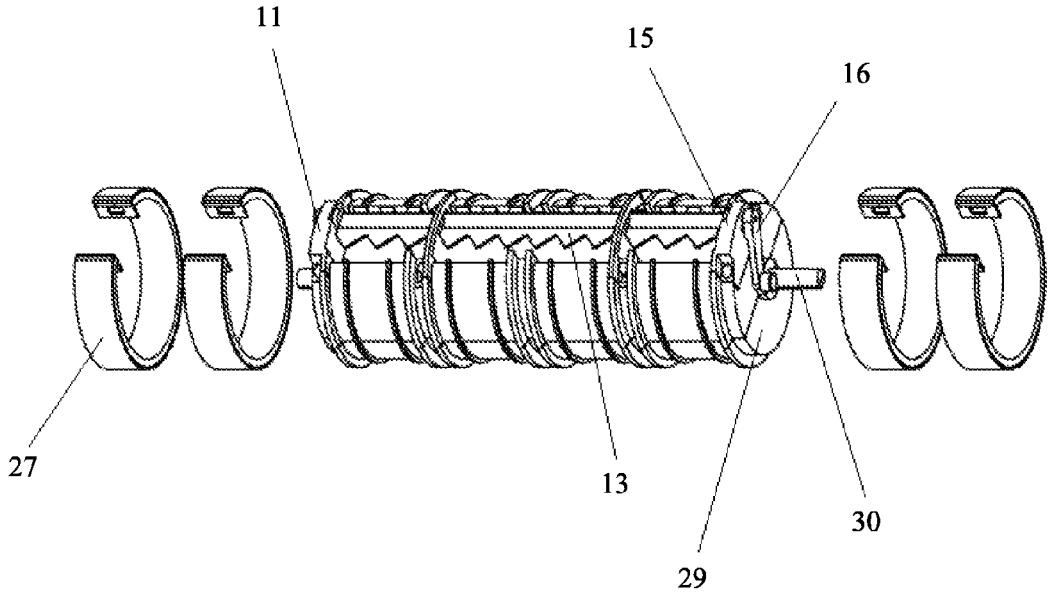
FIG. 3 is a structure view of the paper rolling shaft of the automatic paper cutting device according to the present invention.
Figure 4:
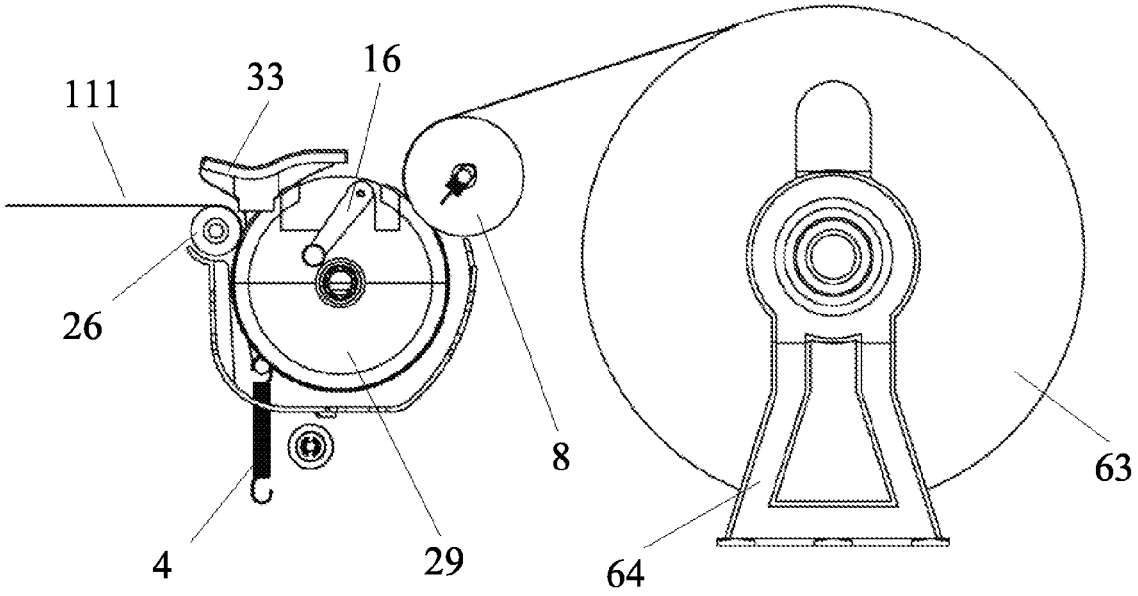
FIG. 4 is a connection structure view of the automatic paper cutting device according to the present invention.

Referring to FIG. 1, FIG. 2, FIG. 3 and FIG. 4 of the drawings, an automatic paper cutting device, comprises a paper reel frame 64 for supporting a paper reel 63, and a core unit 65, wherein the core unit 65 comprises a paper rolling shaft 29 which the head portion 111 of the paper reel 63 rolls around, and the paper rolling shaft 29 is connected to a cutting device.

The head portion 111 of the paper reel 63 rolls around the paper rolling shaft 29, when a user pulls out the head portion 111, the paper rolling shaft 29 rolls and the paper reel 63 is driven to roll, when paper of a certain length is outputted, the paper cutting device is driven to implement cutting.

The core unit 65 comprises a left core unit frame 17 and a right core unit frame 23; a connecting shaft 30 is provided at the center of the paper rolling shaft 29, the paper rolling shaft 29 is installed on the left core unit frame 17 and the right core unit frame 23 via the connecting shaft 30; the paper rolling shaft 29 is installed on the left core unit frame 17 and the right core unit frame 23 via two bearings 19, 21 and two bearing sleeves 18, 22 matching with the bearings 19, 21. The bearings 19, 21 and the bearing sleeves 18, 22 are made of plastic.

A paper inputting guiding roller 8 is provided between the paper rolling shaft 29 and the paper reel frame 64, the head portion 111 of the paper reel 63 rolls on the paper rolling shaft 29. The paper rolling shaft 29 fits the paper inputting guiding roller 8. A first left fixed sleeve 7 and a first right fixed sleeve 9 are provided at the two ends of the paper inputting guiding roller 8. The first left fixed sleeve 7 is connected with a first extension spring 6, the first right fixed sleeve 9 is connected with a second extension spring 10, the first left fixed sleeve 7 and the first right fixed sleeve 9 are respectively provided on the left core unit frame 17 and the right core unit frame 23 via the first extension spring 6 and the second extension spring 10.

The core unit further comprises a paper outputting guiding roller 26, wherein a second left fixed sleeve 25 and a second right fixed sleeve 28 are provided at the two ends of the paper outputting guiding roller 26. The paper outputting guiding roller 26 is provided on the left core unit frame 17 and a right core unit frame 23 via the second left fixed sleeve 25 and the second right fixed sleeve 28. The paper outputting guiding roller 26 is provided above the front of the paper rolling shaft 29. The paper outputting guiding roller 26 fits the paper rolling shaft 29. The head portion 111 of the paper reel 63 rolls on the paper outputting guiding roller 26 through the paper rolling shaft 29.

The paper rolling shaft 29 comprises two detachable connecting parts, the two parts of the paper rolling shaft 29 are connected with each other by connectors, the connectors comprise crews. The two parts of the paper rolling shaft 29 are connected with each other by the crews or other fastening mechanisms. The paper rolling shaft 29 has a long strip groove which the cutting devices are provided in. The cutting devices comprise a paper cutter frame, a paper cutter 13 movably connected with the paper cutter frame. The paper cutter frame comprises a left paper cutter frame 11 and a right paper cutter frame 15, the left paper cutter frame 11 and the right paper cutter frame 15 are respectively connected with guiding pins 12, 14, the left paper cutter frame 11 and the right paper cutter frame 15 are fixedly connected with the paper rolling shaft 29 via the guiding pins 12, 14. The paper cutter frame 11 is connected with a crank mechanism 16, the paper cutter frame 11 is connected with the connecting shaft to implement rolling synchronously via the crank mechanism 16. Preferably, the right paper cutter frame 15 is connected with the crank mechanism 16. When the connecting shaft rolls, the paper cutter frame rolls synchronously via the crank mechanism 16, when the crank mechanism 16 rolls for a stroke, the paper cutter 13 implements cutting paper. When designing, the dimension parameters of the crank mechanism 16 are determined according to the length of the paper outputted each time for insuring that the paper cutter 13 is capable of protruding automatically at a proper position when the connecting shaft rolls, so as to implement outputting the paper of the same length. The paper cutter 13 is movably connected with the paper cutter frame 11, at least 12 cutter teeth are provided on the paper cutter 13.

At a first runtime state, the cutter teeth of the paper cutter 13 face downwardly, the cutter teeth of the paper cutter 13 do not protrude and do not cut down the paper, at a second runtime state, the cutter teeth of the paper cutter 13 face upwardly, the paper implements being cut. When the paper rolling shaft 29 rolls for driving the paper cutter 13 to stretch out at a proper position, it will simpler and more laborsaving to cut the paper because of the upturning angle; and since the paper cutter 13 rotation direction is the same as the paper outputting direction, it is easier to output the paper by this upturning angle.

The paper rolling shaft 29 comprises adhesive tapes 27, at least four adhesive tapes 27 separated from each other are provided along the axial direction of the paper rolling shaft 29. It is easy to grasp the paper rolling on the paper rolling shaft 29 by using the paper rolling shaft 29 with the adhesive tapes 27. The paper rolling shaft 29 has a sticking position for installing the adhesive tapes 27, the shape of the adhesive tapes 27 is a circular ring. The adhesive tapes 27 are made from the separate circular accessories made of the overmolded plastic package. The adhesive tapes 27 directly buckle into the sticking position. Base on ensuring the smooth outputting of paper, the structure that the paper rolling shaft 29 has to be made of the overmolded plastic package overall is simplified, and is reduced costs.

The connecting shaft is connected with an unidirectional spring device, the unidirectional spring device comprises an unidirectional spring 5, a first end of the unidirectional spring 5 is fixedly connected with the connecting shaft, a second end of the unidirectional spring 5 is connected with a connecting rod mechanism, the connecting rod mechanism comprises a connecting rod 3 and a connecting rod hinge 2 connected with the connecting rod 3. The connecting rod mechanism is connected with an extension spring 4, a first end of the extension spring 4 is connected with the connecting rod hinge 2, a second end of the extension spring 4 is connected with an extension spring guiding wheel 1. The extension spring 4 is fixedly connected with the left core unit frame 17.

A user can pull out the paper by hand according to the present invention, under the combined effect of the extension spring, the unidirectional spring device 5 and the connecting rod mechanism, the paper will not reverse into the inner of the mechanism totally, but the paper will be reserved for a short length for pulling out the paper by a next user.

A core unit backplane is provided on the back of the core unit 65, the core unit backplane comprises a core unit front backplane 31 and a core unit back backplane 32. The connecting surface between the core unit front backplane 31 and the core unit back backplane 32 comprises a connector, the core unit front backplane 31 is connected with the core unit back backplane 32 via the connector. The connecting surface between the core unit front backplane 31 and the core unit back backplane 32 comprises a buckle device. The core unit front backplane 31 is connected with the core unit back backplane 32 via the buckle device. Plug-in assemblies are provided on the core unit front backplane 31 and the side surface of the core unit back backplane 32, holes matching with the plug-in assemblies are provided on the left core unit frame 17 and the right core unit frame 23. The core unit front backplane 31 and the core unit back backplane 32 are installed on the left core unit frame 17 and the right core unit frame 23 via the plug-in assemblies.

The core unit 65 further comprises a paper outputting guiding plate 33, long strip holes are provided on the two sides of the paper outputting guiding plate 33, keys matching with the long strip holes are provided on the left core unit frame 17 and the right core unit frame 23, the paper outputting guiding plate 33 is provided on the left core unit frame 17 and the right core unit frame 23 through the coupling of the long strip holes and the keys. At least two guiding paper convexes are provided on the bottom of the paper outputting guiding plate 33, the guiding paper convexes fit the paper outputting guiding roller for pressing the outputted paper to output the cut paper smoothly. Preferably, a barb connector is provided on the paper outputting guiding plate 33, the paper outputting guiding plate is connected with the left core unit frame 17 and the right core unit frame 23 via the barb connector.

A rotated button 24 is provided on the outer of the right core unit frame 23, which is installed on the connecting shaft 30 for adjusting easily in installing process.

The paper reel frame 64 comprises a left frame and a right frame. The left frame is opposite to the right frame, frame convexes are provided on the surface of the left frame that is opposite to the right frame, the frame convexes are for supporting the paper reel 63. the diameter of the paper shaft of the paper reel 63 is 1.5 inches. The diameter of the paper shaft of the paper reel 63 also can be 2 inches or 2.25 inches. Adapters are respectively connected with the frame convexes provided on the left frame and the right frame when the diameter of the paper shaft of the paper reel 63 is 2 inches or 2.25 inches. The adapters comprise the adapters adapting to the paper reels that the diameters of the paper shafts are 2 inches and 2.25 inches. Different adapters are inserted for adapting to the paper reels that the diameters of the paper shafts are different. The bottom of the left frame and the right frame is connected with the base 66 by plugging.

The core unit 65 and the paper reel frame 64 are fixedly connected with a base 66, a shell is provided on the core unit 65 and the outer of the paper reel frame 64, the shell comprises a front shell portion 62 and a transparent window 61 which is coupled with the front shell 62.

The front shell 62 is fixedly connected with the transparent window 61 by plug-in, the front shell 62 is connected with the base 66 by hinging from under to open and close up and down. A lock is provided on the base which directly stretches out from the base 66, a keyhole matching with the lock is provided on the shell, the lock is inserted into the keyhole directly when closing the shell, a professional key is inserted into the keyhole and is pressed down when opening the shell. Two dedicated keys are molded directly by injecting on the base 66, a first key is for daily, a second key is for backup.

An ozone generator is provided at the inner of the frame convex, the gas outlet of the ozone generator is provided at the inner of the shell through the frame convexes; a power inputting terminal is provided on the ozone generator. The two ends of the connecting shaft or the paper inputting guiding roller stretch out from the left core unit frame or the right core unit frame, and a variable speed mechanism is connected with an electric generator, the variable speed mechanism is an accelerated mechanism; the power outputting terminal of the electric generator is connected with the power inputting terminal.

The electric generator is driven to roll when the paper reel 63 is drawn to roll for generating electricity, the ozone generator is driven by the generated electricity for generating ozone to disinfect the paper reel 63. The remaining ozone which has disinfected the paper reel 63 releases into the external space for sterilizing, disinfecting and deodorizating the air in the toilet.

Further preferably, the power outputting terminal of the electric generator is connected with the power inputting terminal of the electric generator via a battery, a power management module is provided between the battery and the power inputting terminal, the power management module outputs electricity when the battery voltage is bigger than a pre-set value till the battery voltage is smaller than another pre-set value. The function of storing enough electric energy in the battery to keep the ozone generator working for a period of time and supplying electric energy after the ozone generator works for a period of time is realized. The problem that the ozone generator works in the unstable intermittent state for a long time or even can not work is avoided.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic paper cutting device, comprising:

a paper reel frame for supporting paper; and a core unit, wherein said core unit comprises a paper rolling shaft which a head portion of said paper reel rolls around, and said paper rolling shaft is connected to a cutting device;

wherein said core unit comprises a left core unit frame and a right core unit frame; a connecting shaft is provided at a center of said paper rolling shaft, said paper rolling shaft is installed on said left core unit frame and said right core unit frame via said connecting shaft;

wherein a paper inputting guiding roller is provided between said paper rolling shaft and said paper reel frame, said head portion of said paper reel rolls on said paper rolling shaft, a first left fixed sleeve and a first right fixed sleeve are provided at two ends of said paper inputting guiding roller, said first left fixed sleeve is connected with a first extension spring, said first right fixed sleeve is connected with a second extension spring, said first left fixed sleeve and said first right fixed sleeve are respectively provided on said left core unit frame and said right core unit frame via said first extension spring and said second extension spring;

wherein said core unit further comprises a paper outputting guiding roller, wherein a second left fixed sleeve and a second right fixed sleeve are provided at two ends of said paper outputting guiding roller, said paper outputting guiding roller is provided on said left core unit frame and said right core unit frame via said second left fixed sleeve and said second right fixed sleeve, said head portion of said paper reel rolls on said paper outputting guiding roller through said paper rolling shaft, said paper outputting guiding roller is provided at a first side of said paper rolling shaft, said paper inputting guiding roller is provided at a second side of said paper rolling shaft;

wherein said paper rolling shaft has a long strip groove which said cutting device is provided in, said cutting device comprises a paper cutter frame, a paper cutter movably connected with said paper cutter frame, said paper cutter frame comprises a left paper cutter frame and a right paper cutter frame, said left paper cutter frame and said right paper cutter frame are respectively connected with guiding pins, said left paper cutter frame and said right paper cutter frame are fixedly connected with said paper rolling shaft via said guiding pins, wherein said paper cutter frame is connected with a crank mechanism, said paper cutter frame is fixedly connected with said connecting shaft via said crank mechanism;

wherein adhesive tapes are provided on said paper rolling shaft, at least four adhesive tapes separated from each other are provided along an axial direction of said paper rolling shaft, said paper rolling shaft has a sticking position for installing said adhesive tapes, a shape of said adhesive tapes is circular ring;

wherein said core unit and said paper reel frame are fixedly connected with a base, a shell is provided on said core unit and an outer of said paper reel frame, said shell comprises a front shell portion and a transparent window which is coupled with said front shell portion;

wherein said connecting shaft is connected with an unidirectional spring device, said unidirectional spring device comprises an unidirectional spring, a first end of said unidirectional spring is fixedly connected with said connecting shaft, a second end of said unidirectional spring is connected with a connecting rod mechanism, said connecting rod mechanism comprises a connecting rod and a connecting rod hinge, said connecting rod hinge is connected with said connecting rod, said connecting rod mechanism is connected with an extension spring, a first end of said extension spring is connected with said connecting rod hinge, a second end of said extension spring is connected with an extension spring guiding wheel, said extension spring is fixedly connected with said left core unit frame.

2. The automatic paper cutting device, as recited in claim 1, wherein a core unit backplane is provided on a back of said core unit, wherein said core unit backplane comprises a core unit front backplane and a core unit back backplane, a connecting surface between said core unit front backplane and said core unit back backplane comprises a connector, said core unit front backplane is connected with said core unit back backplane via said connector, plug-in assemblies are provided on said core unit front backplane and a side surface of said core unit back backplane, holes matching with said plug-in assemblies are provided on said left core unit frame and said right core unit frame, said core unit front backplane and said core unit back backplane are respectively installed on said left core unit frame and said right core unit frame via said plug-in assemblies.

3. The automatic paper cutting device, as recited in claim 2, wherein said core unit further comprises a paper outputting guiding plate, wherein a barb connector is provided on said paper outputting guiding plate, said paper outputting guiding plate is connected with said left core unit frame and said right core unit frame via said barb connector.

* * * * *